US012559885B2

(12) United States Patent
Thaller

(10) Patent No.: US 12,559,885 B2
(45) Date of Patent: Feb. 24, 2026

(54) PROCESS AND APPARATUS FOR PRODUCING BLEACHED CELLULOSE

(71) Applicant: Messer Austria GmbH, Gumpoldskirchen (AT)

(72) Inventor: Bernhard Thaller, Ulmerfeld-Hausmening (AT)

(73) Assignee: Messer Austria GmbH, Gumpoldskirchen (AT)

( * ) Notice: Subject to any disclaimer, the term of this patent is extended or adjusted under 35 U.S.C. 154(b) by 469 days.

(21) Appl. No.: 17/996,473

(22) PCT Filed: Mar. 17, 2021

(86) PCT No.: PCT/EP2021/056877
§ 371 (c)(1),
(2) Date: Oct. 18, 2022

(87) PCT Pub. No.: WO2021/213740
PCT Pub. Date: Oct. 28, 2021

(65) Prior Publication Data

US 2023/0203751 A1 Jun. 29, 2023

(30) Foreign Application Priority Data

Apr. 23, 2020 (DE) ..... 10 2020 002 445.9

(51) Int. Cl.
*D21C 9/147* (2006.01)
*D21C 9/10* (2006.01)
*D21C 9/16* (2006.01)

(52) U.S. Cl.
CPC ..... *D21C 9/147* (2013.01); *D21C 9/1036* (2013.01); *D21C 9/1057* (2013.01); *D21C 9/163* (2013.01)

(58) Field of Classification Search
CPC .... D21C 9/147; D21C 9/1036; D21C 9/1057; D21C 9/163
See application file for complete search history.

(56) References Cited

U.S. PATENT DOCUMENTS

| | | | |
|---|---|---|---|
| 4,053,352 | A | 10/1977 | Hultman et al. |
| 4,886,577 | A | 12/1989 | Wiley |
| 5,382,322 | A | 1/1995 | Magnotta et al. |
| 5,500,085 | A | 3/1996 | Magnotta et al. |

(Continued)

FOREIGN PATENT DOCUMENTS

| | | |
|---|---|---|
| CA | 2111519 A1 | 7/1994 |
| EP | 0588704 A2 | 3/1994 |

(Continued)

OTHER PUBLICATIONS

International Search Report and Written Opinion in PCT/EP2021/056877, dated Jun. 25, 2021, 7 pages.

*Primary Examiner* — Michael E Barr
*Assistant Examiner* — Lauren G Orta
(74) *Attorney, Agent, or Firm* — Andrus Intellectual Property Law, LLP

(57) ABSTRACT

In a process/an apparatus for producing bleached cellulose in which a lignin- and cellulose-containing suspension is subjected to at least one process step for oxygen-assisted bleaching in a reactor, such as alkaline oxygen delignification, oxygen-enhanced extraction or oxygen-enhanced peroxide bleaching, the oxygen required for the oxygen-assisted bleaching is supplied to the reactor at least partially in the form of oxygen-containing nanobubbles. The small size and high stability of the nanobubbles allow uniform distribution of the oxygen in the suspension and a comparatively long exposure time. The efficiency of the bleaching is thus substantially increased.

16 Claims, 1 Drawing Sheet

(56) References Cited

U.S. PATENT DOCUMENTS

| | | | | |
|---|---|---|---|---|
| 6,382,601 | B1 | 5/2002 | Ohnari | |
| 10,293,312 | B2 | 5/2019 | Goi | |
| 2008/0142175 | A1* | 6/2008 | Yin | D21C 9/144 162/9 |
| 2009/0000751 | A1* | 1/2009 | Yin | D21C 9/14 162/34 |
| 2009/0107642 | A1* | 4/2009 | Snekkenes | D21C 9/147 162/17 |
| 2012/0175791 | A1 | 7/2012 | Anzai et al. | |
| 2014/0102648 | A1* | 4/2014 | Vehmaa | D21C 3/24 162/37 |
| 2018/0370867 | A1 | 12/2018 | Lu | |
| 2019/0083945 | A1 | 3/2019 | Zhang et al. | |
| 2021/0189648 | A1 | 6/2021 | Lampinen | |
| 2023/0313456 | A1 | 10/2023 | Thaller | |

FOREIGN PATENT DOCUMENTS

| | | | | |
|---|---|---|---|---|
| EP | 0573892 | B1 | 9/1996 | |
| EP | 1161592 | A1 | 12/2001 | |
| EP | 1528149 | A1 | 5/2005 | |
| JP | H07258987 | A | 10/1995 | |
| JP | 2006342434 | A | 12/2006 | |
| WO | 2000044978 | A1 | 8/2000 | |
| WO | 2001020075 | A1 | 3/2001 | |
| WO | 2006071165 | A1 | 7/2006 | |
| WO | 2013178885 | A1 | 12/2013 | |
| WO | 2015067446 | A1 | 5/2015 | |
| WO | WO-2015197917 | A1 * | 12/2015 | D21C 9/166 |
| WO | 2017091129 | A1 | 6/2017 | |
| WO | WO-2019003655 | A1 * | 1/2019 | A61L 11/00 |
| WO | 2019077202 | A1 | 4/2019 | |
| WO | 2017217402 | A1 | 1/2021 | |

* cited by examiner

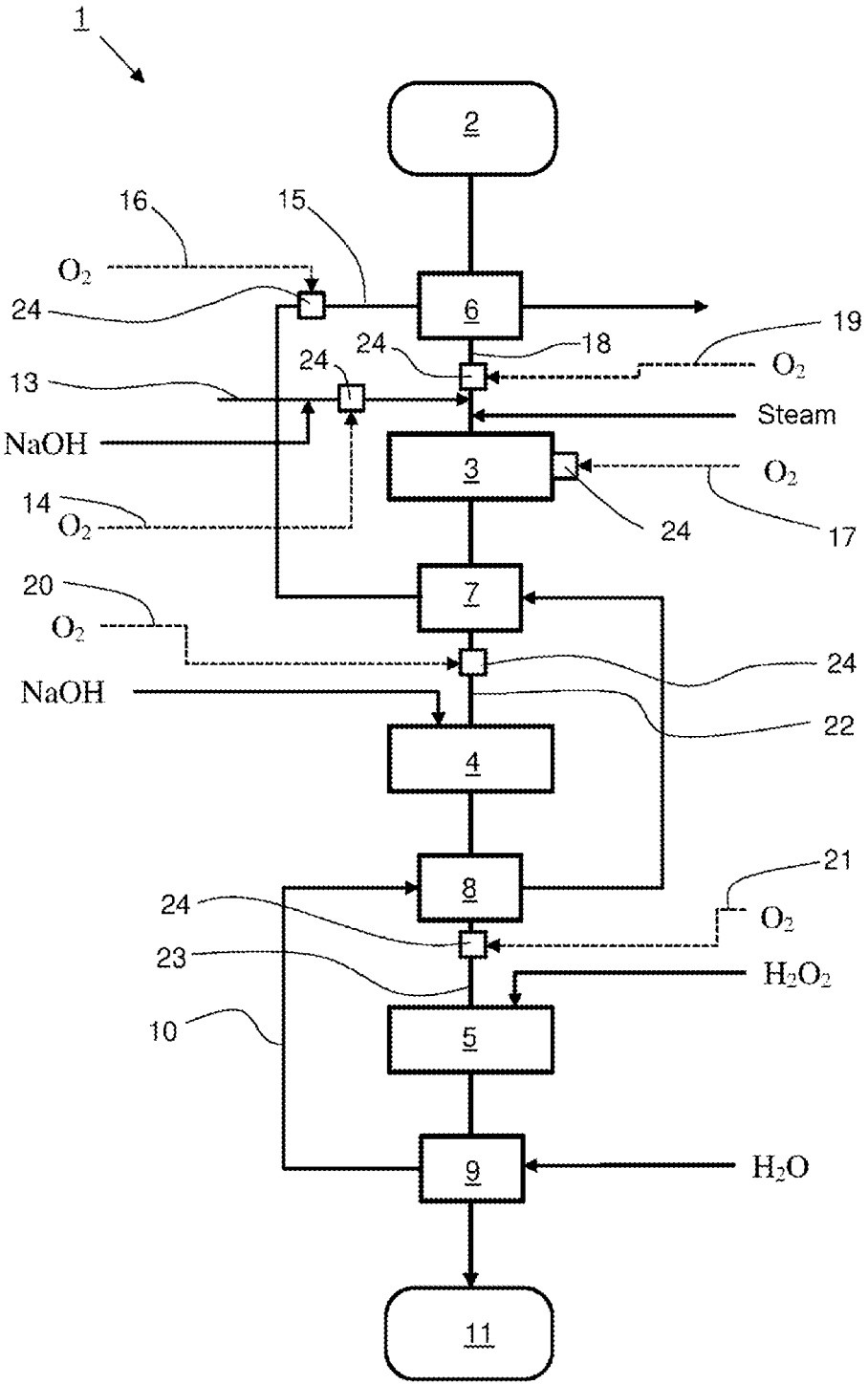
1
2
16
15
$O_2$
24
6
19
24
18
$O_2$
24
13
Steam
NaOH
3
$O_2$
14
$O_2$
24
17
20
7
$O_2$
24
NaOH
22
4
21
8
24
$O_2$
23
$H_2O_2$
10
5
9
$H_2O$
11

PROCESS AND APPARATUS FOR PRODUCING BLEACHED CELLULOSE

CROSS-REFERENCE TO RELATED APPLICATIONS

The present application is the U.S. national stage application of international application PCT/EP2021/056877 filed Mar. 17, 2021, which international application was published on Oct. 28, 2021, as International Publication WO 2021/213740 A1. The international application claims priority to German Patent Application No. 10 2020 002 445.9 filed Apr. 23, 2020.

FIELD

The invention relates to a process for producing bleached chemical pulp, in which a lignin- and chemical pulp-containing suspension is subjected to at least one process step for oxygen-assisted bleaching in a reactor. The invention further relates to a corresponding apparatus.

BACKGROUND

In the production of bleached chemical pulp, an increasingly important role is being played by process steps in which a bleaching operation is effected with the aid of oxygen (called "oxygen-assisted" bleaching hereinafter). For instance, alkaline oxygen delignification is one of the most common process steps in the production of bleached chemical pulp. This involves metering oxygen into an alkaline stream of matter (cellulose fiber/water mixture). Under pressure, at high temperature and in the alkaline medium already mentioned, oxygen reacts with lignin and converts it to a soluble form. The aim of the process step is the removal of lignin from the fibers. In historical one-stage processes, it was possible here to remove up to 50%, and in the two-stage processes that are nowadays customary up to 70%, of the lignin from the stream of matter.

Oxygen is also used in other bleaching stages, such as oxygen-enhanced extraction ("EO", supply of $NaOH+O_2$) or oxygen-enhanced peroxide bleaching ("EOP", supply of $NaOH+O_2+H_2O_2$). In all these cases, good and uniform dissolution of the oxygen in the aqueous stream of matter is one of the crucial parameters for the process regime. However, the greatest difficulty in accomplishing this uniform distribution and dissolution of the oxygen is in oxygen delignification, since the greatest specific amounts of oxygen—compared to the other process stages mentioned—are used here.

However, oxygen delignification in particular also presents some difficulties connected particularly with the fact that oxygen has only sparing solubility in water. In particular, the occurrence of excessively large gas bubbles slows the reaction rate since the gas bubbles can constitute a physical barrier between dissolved oxygen and lignin present in the suspension. In addition, the gas bubbles rise rapidly and pass through the reactor without reacting with lignin.

Various courses of action are known in order to accomplish maximum breadth of distribution of the oxygen in the feed stream of matter, to promote the dissolution of the oxygen and to achieve an efficient reaction with lignin.

For example, EP 1 528 149 A1 discloses subjecting chemical pulp-containing suspension and gas introduced to strong mechanical forces in a reactor in order to establish maximum directness of contact of oxygen and lignin.

The subject matter of EP 3 380 667 A1 is concerned with the problem that gaseous reaction products formed during the bleaching operation in the suspension, especially CO and $CO_2$, compete with oxygen and inhibit the dissolution of oxygen, which lowers the efficiency of oxygen supply. In order to solve this problem, EP 3380667 A1 proposes conducting a two-stage process for oxygen delignification, wherein, after a first stage, the pressurized suspension is depressurized in order to drive out disruptive gases, and in a second stage repressurization is effected with a high partial oxygen pressure. However, this course of action is associated with considerable apparatus complexity.

There have already been proposals to distribute the oxygen in the stream of matter in the form of very small gas bubbles, in order in this way, and with exploitation of a high surface to volume ratio, to create favorable conditions for the dissolution of the gas, as mentioned, for example, in EP 0573892 B1 or U.S. Pat. No. 4,886,577 A1.

In this regard, WO 2006/071165 A1 notes critically that the dissolving operation proceeds much more slowly than the conversion of the already dissolved oxygen in reactions with different organic constituents in the suspension. Since the degradation of the lignin proceeds particularly within fibers present in the suspension, the dissolved oxygen in the liquid phase penetrating into the fibers is said to be rapidly consumed. It is said to be impossible to replace the oxygen consumed quickly enough in the gas bubbles that cannot themselves penetrate into the fibers, with the result that the reaction rate slows down and the efficiency of the reaction is lowered. WO 2006/071165 A1 instead proposes, by intensive mixing of the suspension, keeping the proportion of dissolved oxygen as high as possible in a sustained manner during a sequence of multiple bleaching stages.

SUMMARY

It is an object of the invention, in bleaching using oxygen, to improve the efficiency of the reaction processes in the reactions between the oxygen supplied and lignin present in the suspension compared to prior art processes.

This object is achieved by a process having the features disclosed herein.

According to the present disclosure, the required oxygen is thus introduced at least partly in the form of nanobubbles in at least one of the stages used in the bleaching process for oxygen-assisted bleaching, for example oxygen delignification, oxygen-enhanced extraction or oxygen-assisted peroxide bleaching. Nanobubbles are generated either directly in the suspension or indirectly, by introducing oxygen into a conduit that conveys water or an aqueous fluid directly or indirectly into the reactor in which the process step for oxygen-assisted bleaching, or at least one stage thereof, takes place. At least within the reactor, therefore, the oxygen supplied is thus at least partly in the form of nanobubbles in the chemical pulp suspension.

"Nanobubbles" shall be understood here to mean gas bubbles having a diameter between 20 nm and 1 μm. The term "nanobubble" is especially meant by way of distinction from larger bubbles having a diameter between 1 μm and 100 μm, which in the context of the present invention are referred to as "microbubbles". It has been found in various studies that nanobubbles having a diameter of more than 20 nm can remain stable in water over a long period of several weeks or even longer. By contrast with microbubbles, they do not rise to the surface of water, since the rising motion caused by the comparatively small buoyancy force is disrupted by Brownian molecular motion and almost completely eliminated. At the same time, the zeta potential at the surface of the nanobubbles is large enough to compensate for the surface tension and thus to prevent dissolution of the nanobubble. Only at a diameter of well below 20 nm does surface tension become dominant, collapsing the nanobubbles and causing them to disappear within fractions of a second. Moreover, nanobubbles, on account of repulsive interactions of their surfaces, do not tend to coagulate. A size of the nanobubbles that is preferred in the context of the invention is an average diameter between 20 nm and below 1 μm, preferably an average diameter between 20 nm and 500 nm, more preferably between 20 nm and 200 nm.

Nanobubbles are capable of exchanging matter with their environment. A nanobubble laden with a particular gas, depending on the saturation of this gas in a surrounding solution, can release gas molecules into or absorb them from the solution. In the context of an oxygen-assisted bleaching method, the nanobubbles are filled with oxygen or an oxygenous gas and thus constitute a stable reservoir of oxygen capable of rapidly replacing the oxygen dissolved in the surrounding chemical pulp suspension, which is converted in the course of the lignin reactions. In addition, the nanobubbles are sufficiently small that they can penetrate even into lignin-containing fibers in the suspension, where they can ensure sustained oxygen supply for the lignin reaction.

Processes and apparatuses for generation of nanobubbles in aqueous systems are described, for example, in US 2012/0175791 A1, US 2019/0083945 A1, U.S. Pat. No. 6,382,601 B1, U.S. Pat. No. 10,293,312 B2 or WO 2017/217402 A1, to which reference is made here, but without any intention that the manner of introduction of the nanobubbles according to the present invention be restricted to these known systems. What is essential to the present invention is that the apparatus is designed such that a significant portion of the oxygen supplied to an aqueous fluid is produced in the form of nanobubbles. This is accomplished, for example, by introducing the oxygen through a nozzle or a bubbling apparatus manufactured at least partly from a porous material, for instance sintered ceramic or sintered metal, the pore diameter of which is sufficiently large as to form nanobubbles of the desired order of size that are stable in the fluid. For example, the diameters of the pores in the porous material are likewise in the nanoscale range, i.e. below 1 μm.

Parameters such as pH and salinity have an influence especially on the minimum size of the nanobubbles from which the nanobubbles can be present stably in the solution. In order to ensure that a maximum proportion of the oxygen may be present in the suspension in the form of stable nanobubbles, it is therefore appropriate to choose the type of the introduction system so as to take account of the average size of the bubbles produced on introduction and the stability thereof under the conditions that prevail in the chemical pulp suspension. This can be effected empirically, for example, by testing various introduction systems prior to sustained implementation and determining the suitability thereof for the respective chemical system.

The dosage of the oxygen in the form of nanobubbles may be used in all oxygen-assisted bleaching stages in the bleaching process, especially in alkaline oxygen delignification, in oxygen-enhanced extraction ("EO"), in which the chemical pulp suspension is supplied not only with sodium hydroxide solution (NaOH) but also oxygen, or oxygen-enhanced peroxide bleaching ("PO" or "EOP"), in which the chemical pulp suspension is supplied not only with hydrogen peroxide ($H_2O_2$) and optionally sodium hydroxide solution but likewise with oxygen. If two or more of these bleaching stages are used, the process of the invention may also be used solely in one or more of these bleaching stages. The same applies to successive stages of an oxygen delignification conducted in multiple stages. A process step for oxygen-assisted bleaching with the oxygen-supply of the invention may incidentally also be effected in addition to a non-oxygen-assisted bleaching stage, for example a delignification stage with $CO_2$.

The arrangement of mechanical devices, such as stirrers, rotors etc., must be effected such that mechanical effects such as strong shear forces or cavitation do not impair the stability of the nanobubbles.

The supply of oxygen in the form of nanobubbles may be directly into the chemical pulp suspension, or into a feed via which the reactor in which the respective bleaching stage proceeds is supplied with water or an aqueous fluid. For example, the supply of the nanobubbles is into a process water, for example filtrate, which has been obtained in one or more later wash stages and is being returned in countercurrent to the bleaching process to one or more upstream wash stages and will likewise be used there, for example, as dilution water. Likewise conceivable is the supply of the oxygen in the form of nanobubbles into a fresh water feed that opens directly into the respective reactor or into a conduit that conveys an aqueous fluid, for example a solution of NaOH or $H_2O_2$ or the chemical pulp suspension itself to the reactor.

The process of the invention is especially also suitable for introduction of oxygen into chemical pulp suspensions of comparatively high consistency, especially for treatment of chemical pulp suspensions of moderate consistency (MC) having consistencies between 8% and 20%, preferably between 10% and 14%. Higher consistencies of up to 35% are also conceivable. In this case, the oxygen is supplied in the form of nanobubbles preferably in dilution water that has been introduced into the chemical pulp suspension.

The object of the invention is also achieved by an apparatus having the features disclosed herein.

An apparatus for production of bleached chemical pulp, having at least one reactor in which a lignin- and chemical pulp-containing suspension (chemical pulp suspension) is subjected to at least one process step for alkaline oxygen-assisted bleaching, in accordance with the invention, is characterized in that the reactor and/or a feed for the chemical pulp suspension and/or for an aqueous fluid to be supplied to the reactor, for example wash water or an NaOH- or peroxide-containing fluid, that has flow connection to the reactor has an assigned introduction apparatus for introducing oxygen in the form of oxygen-containing nanobubbles.

The introduction apparatus(es) comprise(s), for example, a nozzle or a bubbling system manufactured at least partly from porous material, for example sintered ceramic or sintered metal. The pore diameters of the porous section are sufficiently large as to form nanobubbles of the desired order of size that are stable in the fluid, i.e., for example, have pore diameters corresponding to the size of nanobubbles to be introduced, i.e. between 20 nm and 1000 nm. In the state of operation, the porous section extends into the chemical pulp suspension or the fluid and hence permits the generation of the nanobubbles directly on introduction of the oxygen into the respective fluid.

BRIEF DESCRIPTION OF THE DRAWING

The drawing is intended to elucidate a working example of the invention in detail. The sole drawing (FIG. 1) shows a flow diagram for a working example of the process of the invention.

DETAILED DESCRIPTION

FIG. 1 shows a process 1 for bleaching of chemical pulp which is used, for example, as precursor for the production of paper or other products. In this process, an aqueous chemical pulp suspension 2 comprising not only chemical pulp but also fractions of lignin passes through the successive oxygen-assisted bleaching stages of an alkaline oxygen delignification 3, an oxygen-enhanced alkaline extraction 4 and an oxygen-enhanced peroxide bleaching 5.

In the oxygen delignification 3, the chemical pulp suspension 2 is treated with oxygen in an alkaline environment in a pressure-resistant reactor at high temperatures. This removes significant proportions of the lignin still present in the suspension by reaction with oxygen. For reasons of clarity, just one process step for oxygen delignification 3 is shown here; the oxygen delignification 3 may be effected here in a single reactor or—as is customary in modern bleaching processes—in multiple stages in multiple reactors connected in series.

The oxygen delignification 3 requires an alkaline medium having a pH of about pH=11 at a temperature between 80° C. and 105° C., which, in the working example shown here, is achieved by the supply of NaOH and of hot steam to the reactor. The suspension here has an average consistency of, for example, 10% to 14%. Oxygen or an oxygenous gas is introduced into the reactor(s). In the comparatively unusual case nowadays of a one-stage oxygen delignification, the treatment is effected at a pressure of, for example, 7 to 8 bar in the feed and 4.5 to 5.5 bar in the output from the (single) reactor. The treatment time (retention time) here is, for example, 50 to 60 min. In the case of a two-stage oxygen delignification, there is generally a difference in pressure and reaction time in the two reactors. In the first stage, for example, a customary pressure is a pressure of 7 to 10 bar and a customary retention time is 10 to 15 minutes, and in the second stage a pressure of 3 to 5 bar with a retention time of about 1 h.

In the subsequent alkaline extraction 4, the lignin remaining after the delignification is rendered largely soluble by means of NaOH. The addition of oxygen here enhances the bleaching action ("EO", oxygen-enhanced extraction). The treatment is effected in a reactor at a temperature of, for example, 55° C.-80° C. and a pressure of, for example, between atmospheric pressure and 3-4 bar, with a residence time of, for example, 60 to 120 min.

In the peroxide bleaching 5, the suspension is supplied, as a further bleaching agent, with a peroxide, especially hydrogen peroxide ($H_2O_2$). The efficiency of this process step can also be significantly improved by addition of oxygen ("PO", oxygen-enhanced peroxide bleaching). The treatment is effected in a reactor, for example at atmospheric pressure and a temperature of, for example, between 85° C. and 90° C. or under an elevated pressure at temperatures of, for example, between 100° C. and 110° C.

It will be apparent that process steps 3, 4, 5 shown here need not necessarily all be conducted, and all in the manner described here; in the context of the invention, it is possible for individual or multiple steps among these to be present, optionally in combination with further bleaching stages that are not described here.

Connected upstream or downstream of the bleaching stages 3, 4, 5, in a manner known per se, are in each case wash stages 6, 7, 8, 9. In the final wash stage 9, an aqueous medium is supplied, for example fresh water or condensate. The filtrate obtained in the wash stage 9—likewise in a manner known per se—is fed via a filtrate and wash water conduit 10, in each case in countercurrent to the running of the chemical pulp suspension, to the respective prior wash stage 8, 7, 6. At the end of last wash stage 9, a suspension formed as intermediate with at least largely bleached chemical pulp 11 is fed to downstream processing steps that are of no further interest here.

As mentioned, in bleaching stages 3, 4, 5, oxygen is supplied, directly or indirectly into the reactors that accommodate the respective bleaching stages 3, 4, 5. According to the invention, this introduces at least a portion of the oxygen in the form of nanobubbles having an average diameter between 20 nm and 1000 nm. The working example disclosed here, by way of example, shows various options for sites where oxygen can be introduced in the form of nanobubbles.

For example, oxygen can be supplied to the alkaline oxygen delignification 3 by introduction of oxygen in the form of nanobubbles in a feed 13 for reflux water, into which the sodium hydroxide solution also required for the alkaline oxygen delignification 3 is also fed, as shown by the oxygen supply 14. However, the introduction of oxygen in the form of nanobubbles may also, additionally or alternatively, be effected in a feed 15 for wash water into the wash stage 6 upstream of the oxygen delignification 3 (oxygen feed 16), in an oxygen feed 17 that opens directly into the reactor (or one or more of the reactors) of the oxygen delignification 3 and/or in a transport conduit 18 that feeds the chemical pulp-containing suspension to the reactor (or one of the reactors) of the oxygen delignification 3, as indicated by oxygen feed 19.

In the same way, there exist various options for the supply of oxygen in the alkaline extraction 4 and the peroxide bleaching 5 as well; at the same time, the drawing, for reasons of clarity, shows only oxygen feeds 20, 21 that open into a transport conduit 22, 23 arranged upstream of the respective reactor for the chemical pulp suspension.

The introduction of the oxygen in the form of nanobubbles, incidentally, is not limited to the point of entry shown here; instead, the introduction can also be effected at other points that are not shown here.

Incidentally, it is no way obligatory in the context of the invention for the oxygen to be introduced exclusively in the form of nanobubbles; instead, it is also possible that the oxygen is introduced in the form of nanobubbles in addition to other modes of introduction for the oxygen.

Nanobubbles are produced in each case at the opening of the oxygen feeds 14, 16, 17, 19, 20, 21 into the respective fluid-conducting conduit 13, 15, 18, 22, 23 and/or the respective reactor in suitable introduction apparatuses 24. All that is required here is that, in operation of the introduction apparatuses 24, this at least with one apparatus that produces the nanobubbles, for example a nozzle, is surrounded by water or an aqueous fluid or a suspension, such that the nanobubbles can form in the aqueous phase. The nanobubbles are then entrained by the flow of the respective fluid and hence arrive in the respective reactor for the reaction 3, 4, 5. Incidentally, such an introduction device 24 that permits the production of oxygen-containing nanobubbles in the respective fluid may also be provided solely at one or some of the openings mentioned in the oxygen feeds 14, 16, 17, 19, 20, 21.

The process of the invention makes it possible to use the oxygen introduced into the chemical pulp suspensions over the course of the various bleaching stages with significantly higher efficiency than is the case in prior art processes. The small size of the nanobubbles enables uniform distribution of the oxygen in the suspension and facilitates the transport of the oxygen directly to the lignin to be oxidized. In addition, the nanobubbles, in regions where there is a high oxygen demand, constitute a readily available reservoir for oxygen.

LIST OF REFERENCE NUMERALS

1. Process
2. Chemical pulp suspension
3. Alkaline oxygen delignification
4. Alkaline oxygen-enhanced extraction
5. Oxygen-enhanced peroxide bleaching
6. Wash stage
7. Wash stage
8. Wash stage
9. Wash stage
10. Filtrate and wash water conduit
11. Suspension comprising bleached chemical pulp
12. -
13. Feed (for dilution water, NaOH)
14. Oxygen feed
15. Feed for wash water
16. Oxygen feed
17. Oxygen feed
18. Transport conduit
19. Oxygen feed
20. Oxygen feed
21. Oxygen feed
22. Transport conduit
23. Transport conduit
24. Introduction device

The invention claimed is:

1. A process for producing bleached chemical pulp comprising:

subjecting a suspension containing lignin and chemical pulp to a first process step for oxygen-assisted bleaching in a first reactor, wherein oxygen required for the first process step is supplied to the first reactor at least partly in the form of oxygen-containing nanobubbles via a first introduction device in a first transport conduit supplying the suspension to the first reactor;

subjecting the suspension to a second process step for oxygen-assisted bleaching in a second reactor downstream from the first reactor, wherein oxygen required for the second process step is supplied to the second reactor at least partly in the form of oxygen-containing nanobubbles via a second introduction device in a second transport conduit supplying the suspension to the second reactor from the first reactor; and subjecting the suspension to a third process step for oxygen-assisted bleaching in a third reactor downstream from the second reactor, wherein oxygen required for the third process step is supplied to the third reactor at least partly in the form of oxygen-containing nanobubbles via a third introduction device in a third transport conduit supplying the suspension to the third reactor from the second reactor;

wherein the second process step is different than the first process step, and wherein the third process step is different than the first process step and the second process step; and wherein the first process step for oxygen-assisted bleaching is preceded by a wash stage in which wash water is supplied to the suspension, wherein the oxygen-containing nanobubbles are supplied to the first reactor at least partly by a wash introduction device that is located in a feedline supplying the wash water to the wash stage and that generates the oxygen-containing nanobubbles in the wash water for the wash stage.

2. The process as claimed in claim 1, wherein the oxygen-containing nanobubbles are supplied at least partly by generating nanobubbles in a feed for fresh water having flow connection to at least one of the first reactor, the second reactor or the third reactor, in a feed for process water, and/or in a feed for a chemical used in the oxygen-assisted bleaching.

3. The process as claimed in claim 1, wherein the oxygen-containing nanobubbles are supplied to the first reactor at least partly by generating nanobubbles in the first reactor via a reactor introduction device.

4. The process as claimed in claim 1, wherein the first process step performed in the first reactor comprises a process step of oxygen delignification;

wherein the second process step performed in the second reactor comprises a process step for oxygen-enhanced extraction; and wherein the third process step performed in the third reactor comprises a process step for oxygen-enhanced peroxide bleaching.

5. The process as claimed in claim 1, wherein the suspension into which the oxygen-containing nanobubbles are introduced has a consistency between 8% and 35%.

6. The process as claimed in claim 5, wherein the suspension into which the oxygen-containing nanobubbles are introduced has a consistency between 10% and 14%.

7. The process as claimed in claim 1, wherein the first process step performed in the first reactor comprises a process step of oxygen delignification.

8. The process as claimed in claim 7, wherein the oxygen required for the process step of oxygen delignification is supplied to the first reactor at least partly in the form of oxygen-containing nanobubbles via the first introduction device and via a reactor introduction device located in the first reactor.

9. The process as claimed in claim 7, wherein the oxygen required for the process step of oxygen delignification is supplied to the first reactor at least partly in the form of oxygen-containing nanobubbles via the first introduction device and via a fourth introduction device located in a chemical transport conduit supplying chemicals necessary for the process step of oxygen delignification.

10. The process as claimed in claim 1, wherein the second process step performed in the second reactor comprises a process step for oxygen-enhanced alkaline extraction.

11. The process as claimed in claim 1, wherein the third process step performed in the third reactor comprises a process step for oxygen-enhanced peroxide bleaching.

12. The process as claimed in claim 1, wherein the wash stage is a first wash stage upstream from the first reactor, and the process further comprises:

supplying wash water to the suspension in a second wash stage downstream from the first reactor and upstream from the second reactor; and supplying wash water to the suspension in a third wash stage downstream from the second reactor and upstream from the third reactor.

13. The process as claimed in claim 12, wherein the first wash stage is performed upstream from the first introduction device.

14. The process as claimed in claim 12, wherein the second wash stage is performed downstream from the first reactor and upstream from the second introduction device.

15. The process as claimed in claim 12, wherein the third wash stage is performed downstream from the second reactor and upstream from the third introduction device.

16. The process as claimed in claim 12, wherein the feedline supplies the wash water from the second wash stage to the first wash stage.

* * * * *